US007713069B2

(12) United States Patent
Cole et al.

(10) Patent No.: US 7,713,069 B2
(45) Date of Patent: May 11, 2010

(54) ELECTRICAL CONNECTOR AND ASSEMBLY

(75) Inventors: Jordan Marshall Cole, San Jose, CA (US); Brian Patrick Costello, Scotts Valley, CA (US); Yun Jaan See, Singapore (SG)

(73) Assignees: Tyco Electronics Corporation, Berwyn, PA (US); Tyco Electronics Singapore Pte. Ltd., Singapore (SG)

( * ) Notice: Subject to any disclaimer, the term of this patent is extended or adjusted under 35 U.S.C. 154(b) by 27 days.

(21) Appl. No.: 12/114,503

(22) Filed: May 2, 2008

(65) Prior Publication Data

US 2009/0275219 A1 Nov. 5, 2009

(51) Int. Cl.
*H01R 29/00* (2006.01)

(52) U.S. Cl. ..... 439/66; 439/660

(58) Field of Classification Search ..... 439/66, 439/660, 630, 862

See application file for complete search history.

(56) References Cited

U.S. PATENT DOCUMENTS

| | | | | |
|---|---|---|---|---|
| 5,746,626 | A | 5/1998 | Kwiat et al. | |
| 5,752,841 | A | 5/1998 | Hori | |
| 5,879,169 | A * | 3/1999 | Wu | 439/74 |
| 6,048,228 | A | 4/2000 | Aso | |
| 6,113,440 | A * | 9/2000 | Fijten et al. | 439/862 |
| 6,120,304 | A | 9/2000 | Harwood et al. | |
| D455,126 | S | 4/2002 | Wu | |
| 6,454,607 | B2 * | 9/2002 | Bricaud | 439/630 |
| 6,890,216 | B2 | 5/2005 | Matsunaga et al. | |
| 6,994,576 | B2 * | 2/2006 | Tanaka et al. | 439/188 |
| D529,443 | S | 10/2006 | Chien | |
| D531,958 | S | 11/2006 | Yang et al. | |
| D559,180 | S | 1/2008 | Lai et al. | |
| D559,181 | S | 1/2008 | Yan | |
| D561,099 | S | 2/2008 | Kobayashi | |
| D561,100 | S | 2/2008 | Hsu et al. | |
| 2005/0130510 | A1 * | 6/2005 | Zheng et al. | 439/862 |
| 2005/0208834 | A1 | 9/2005 | Kodaira et al. | |
| 2006/0172563 | A1 * | 8/2006 | Soh | 439/66 |
| 2007/0148998 | A1 * | 6/2007 | Liao et al. | 439/66 |
| 2007/0161274 | A1 | 7/2007 | Tanaka et al. | |
| 2008/0003843 | A1 * | 1/2008 | Ruttan et al. | 439/66 |
| 2008/0293272 | A1 * | 11/2008 | Trout et al. | 439/154 |

* cited by examiner

*Primary Examiner*—Gary F. Paumen

(57) ABSTRACT

An electrical connector configured to interconnect first and second electrical components. The connector includes a connector housing that is coupled to the first electrical component. The connector housing has a mating face that extends substantially in an axial direction and includes a slot opening. The connector also includes a connector contact that extends through the connector housing and the slot opening. The connector contact has a base portion located a depth within the connector housing and a curved portion formed along and protruding through the slot opening and beyond the mating face. The connector contact is configured to pivot about the base portion when a mating contact of the second electrical component is moved alongside the mating face in the axial direction and engages the curved portion. The curved portion is movable within and along the slot opening in the axial direction.

20 Claims, 5 Drawing Sheets

ELECTRICAL CONNECTOR AND ASSEMBLY

BACKGROUND OF THE INVENTION

The subject matter herein relates generally to electrical connectors and more particularly, to electrical connectors configured to engage mating contacts that are inserted in a direction that is substantially orthogonal to a mating face of the connector.

With some known electronic devices, such as portable computers, peripheral devices may be connected to the electronic device using a plug that is configured to mate with the electronic device. For example, the plug may be inserted into a side slot or cavity that is grooved or keyed to mate with the plug. The mating contacts within the slot are configured to engage mating contacts on the plug when the plug is in a fully engaged position within the slot. However, in order to ensure that the slot contacts and the plug contacts properly engage, the slot contacts and the plug contacts are positioned in a predetermined arrangement. For example, the slot contacts and the plug slots may be arranged in rows and/or columns. However, when the slot contacts or the plug contacts are in a predetermined arrangement, the slot contacts may only be used with plugs that have a predetermined arrangement of plug contacts and vice-versa.

Furthermore, in some known electrical connectors, the plug contacts are contact pads that project outwardly from a wall of the plug body. When the plug is inserted into the cavity the contact pads face a direction that is orthogonal to the insertion direction of the plug. As such, sides of the contact pads may stub or incorrectly hit the slot contacts or other parts within the slot thereby damaging or limiting the lifetime of the contact pads.

Thus, there is also a need for electrical connectors having plug contacts that may engage different arrangements of slot contacts. In addition, there is a need for electrical connectors that effectively mate the contact pads to the plug contacts while reducing the damage and/or wear of the contact pads as compared to the known electrical connectors.

BRIEF DESCRIPTION OF THE INVENTION

In one embodiment, an electrical connector configured to interconnect first and second electrical components is provided. The connector includes a connector housing having a mating face that extends substantially in an axial direction and includes a slot opening. The connector also includes a connector contact that extends through the connector housing and the slot opening and is electrically coupled to the first electrical component. The connector contact has a base portion located a depth within the connector housing and a curved portion formed along and protruding through the slot opening and beyond the mating face. The connector contact is configured to pivot about the base portion when a mating contact of the second electrical component is moved alongside the mating face in the axial direction and engages the curved portion. The curved portion is movable within and along the slot opening in the axial direction.

Optionally, the connector contact may include a beam connecting the base portion and the curved portion. The beam may extend in a direction that is substantially perpendicular to the mating face. Also, the connector housing may include a pair of opposing inner walls where the base portion of the connector contact is held by and between the inner walls. Further, the connector may include a plurality of slot openings extending along the mating face and a plurality of connector contacts. Each connector contact may extend through the connector housing and one of the slot openings.

In another embodiment, an electrical assembly is provided that includes an electronic device having a connector housing that includes a surface and a first electrical component held within the connector housing. The assembly also includes a second electrical component that has a mating contact, and a connector. The connector includes a connector housing that has a mating face extending substantially in an axial direction. The mating face includes a slot opening. The connector also includes a connector contact that extends through the connector housing and the slot opening and is electrically coupled to the first electrical component. The connector contact has a base portion located a depth within the connector housing and a curved portion formed along and protruding through the slot opening and beyond the mating face. The connector contact is configured to pivot about the base portion when a mating contact of the second electrical component is moved alongside the mating face in the axial direction and engages the curved portion. The curved portion is movable within and along the slot opening in the axial direction.

DETAILED DESCRIPTION OF THE INVENTION

Figure 1:
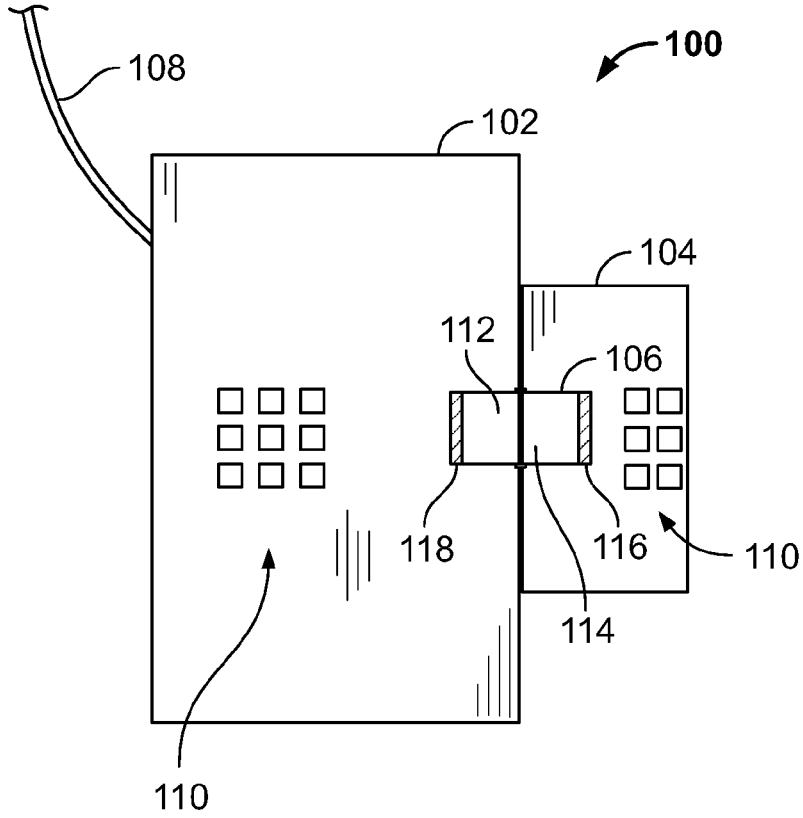
FIG. 1 is a schematic illustration of an electronic assembly utilizing a pair of electrical connectors formed in accordance with one embodiment.

FIG. 1 is a schematic illustration of an electronic assembly 100 that includes electrical systems or devices 102 and 104 connected by an electronic module 106. The module 106 transmits power and/or electrical signals between the devices 102 and 104. Also, the module 106 may mechanically support the device 104 while the assembly 100 is in operation. In one embodiment, the device 102 is a primary device that may operate solely without the device 104 connected thereto, and the device 104 is a secondary device that adds functionality to the device 102. For example, the device 102 may be a communications device. More specifically the device 102 may be a desktop or portable computer, a peripheral device for computers, a personal digital assistant (PDA), ATM machine, or a control panel for a security system. The devices 102 and 104 may include additional features or buttons 110 that may be operated by an individual for controlling the operation of or interacting with the other device. Furthermore, the devices 102 and 104 are not required to be directly linked or connected by the module 106. For example, the device 102 may be a computing system located in a remote location with respect to the module 106 and the device 104. The device 102 may be communicatively coupled (e.g., through cables and/or wireless networks) to an electrical connector that engages with the module 106.

As illustrated in FIG. 1, the module 106 may have a pair of module mating faces 112 and 114 that are inserted into a cavity or coupled to a surface of the corresponding electronic devices 102 and 104, respectively. In FIG. 1, the module 106 holds the devices 102 and 104 directly adjacent to one another. However, alternative embodiments may hold the devices 102 and 104 a predetermined distance apart. As will be discussed in greater detail below, the mating faces 112 and 114 form an electrical connection with electrical connectors 118 and 116, respectively, for transmitting power and/or electrical signals therebetween. More specifically each mating face 112 and 114 may include mating contacts 122 and 124 (shown in FIG. 2) that electrically connect with connector contacts 148 (shown in FIG. 3) of the corresponding electrical connector 116 and 118.

Figure 2:
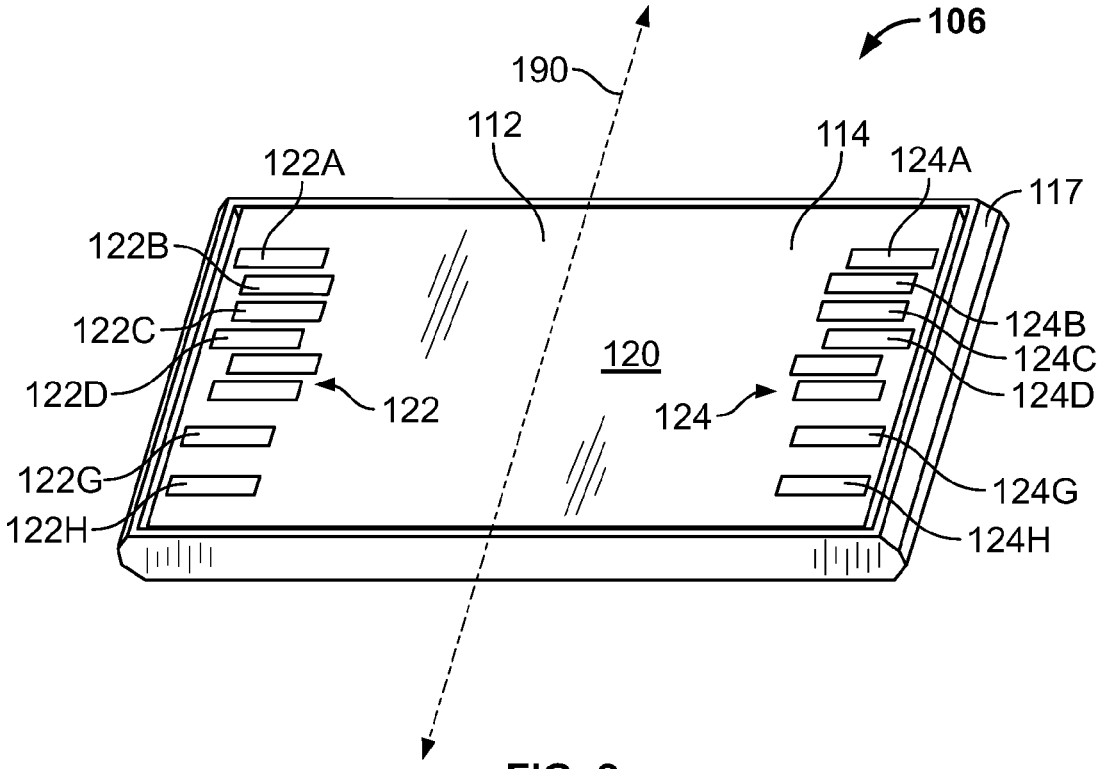
FIG. 2 is a perspective view of an electronic module that may be used with the assembly shown in FIG. 1.

FIG. 2 is a perspective view of the module 106 having the mating faces 112 and 114. The module 106 includes a frame 117 having the mating faces 112 and 114 thereon. In the illustrated embodiment, the mating faces 112 and 114 share a common surface 120. However, in alternative embodiments, the frame 117 may form separate surfaces for the mating faces 112 and 114. Furthermore, although FIG. 2 shows the frame 117 being substantially rectangular and the mating faces 112 and 114 being aligned with one another and extending in opposite directions, the frame 117 may have other shapes and the mating faces 112 and 114 may have other positions and/or other orientations (i.e., the surfaces of the mating faces 112 and 114 are not required to face a common direction but may, for example, be orthogonal to each other).

As shown, each mating face 112 and 114 includes a plurality of mating contacts 122 and 124, respectively. The mating contacts 122 (or, separately the mating contacts 124) may be aligned in a staggered relationship with respect to each other in order to accommodate for or obtain a desired electrical performance of the assembly 100 (FIG. 1). Each mating contact 122 is in electrical communication with a corresponding mating contact 124. By way of example, the mating contact 122A is in electrical communication with the mating contact 124A via a conductor (not shown) that extends between the mating contact 122A and the corresponding mating contact 124A. Alternatively, the mating contacts may be electrically coupled via traces on a circuit board. Each pair of mating contacts 122 and 124 (and the conductor extending therebetween) may be configured for a separate purpose. For example, mating contacts 122B and 124B and mating contacts 122C and 124C may be signal lines for transmitting data therebetween. The mating contacts 122D and 124D may be a ground. The mating contacts 122G and 124G and 122H and 124H may be power lines for transmitting power therebetween. In one embodiment, the power lines are capable of transmitting a hazardous voltage (e.g., 48V) therebetween and/or the signal lines are capable of transmitting high speed electrical signals.

Also shown, the mating contacts 122 may have a symmetrical relationship with the mating contacts 124 relative to a central axis extending therebetween. Alternatively, the mating contacts 122 and 124 do not have symmetrical relationships. Furthermore, other embodiments may not have a one-to-one relationship with respect to mating contacts 122 and mating contacts 124. For example, the module 106 may have additional circuitry within the frame 117 that performs operations on the signals received.

In the illustrated embodiment, the module 106 may be removably coupled to the devices 102 and 104 (FIG. 1). As used herein, the term "removably coupled" means that the module 106 may be readily separated from the devices 102 and/or 104 without destroying the module 106 and the devices 102 and 104. For example, the module 106 may have threaded holes for receiving threaded fasteners, latches, or other methods where a technician may easily remove the module 106 from the devices 102 and 104. In addition, the mating faces 112 and 114 may form an interference fit with the devices 102 and 104. In alternative embodiments, the module 106 is not removably coupled to the devices 102 and 104.

In one embodiment the mating contacts 122 and 124 are formed into a contact pads that project a distance $D_1$ (shown in FIG. 6) from the surface 120. However, in alternative embodiments, the mating contacts 122 and 124 may be flush with the surface 120 or be slightly embedded within an aperture or cavity of the module 106. Also, the mating contacts 122 and 124 may have an arm that projects from the surface 120 at a non-orthogonal angle.

Figure 3:
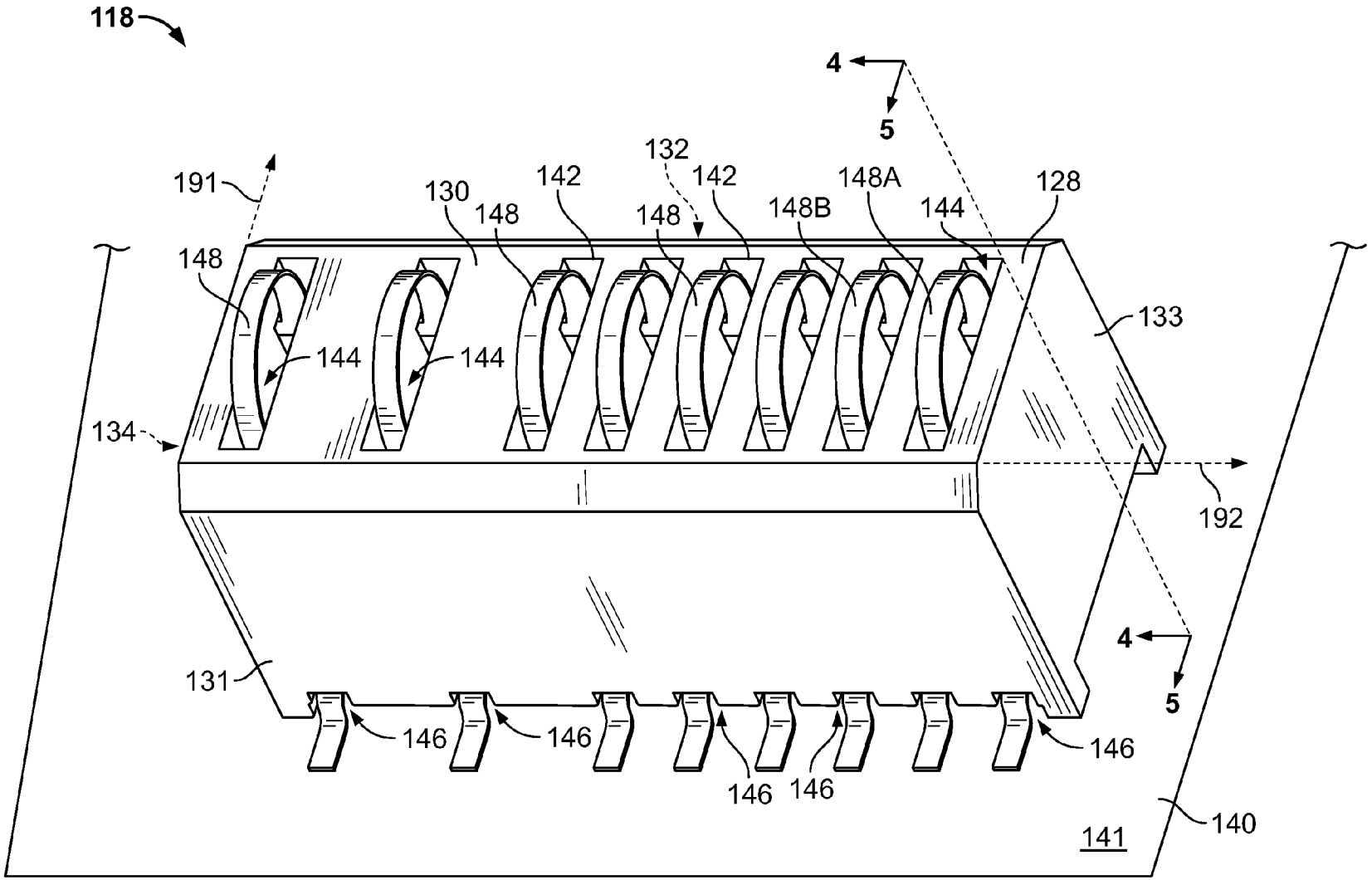
FIG. 3 is a front perspective view of one electrical connector that may be used with the assembly shown in FIG. 1.

FIG. 3 is a front perspective view of the connector 118. Although the following is with reference to the connector 118, the description may be similarly applied to the connector 116 (FIG. 1). As shown, the connector 118 includes a connector housing 128 and a plurality of connector contacts 148. The connector housing 128 may have a substantially rectangular shape formed by or partially formed by a dielectric material. The connector housing 128 may have a plurality of sides 130-134 including a mating face 130, a front side 131, and back side 132. The mating face 130 extends along a plane formed by axes 191 and 192. The axis 191 extends axially along the mating face 130 between the front side 131 and the back side 132, and the axis 192 extends laterally between the side 134 and the side 133.

The connector 118 may be coupled to an electrical component 140, which is illustrated as a circuit board 141 in FIG. 3. The mating face 130 forms a plurality of slot openings 142 that lead into a common chamber 144 housed by the connector housing 128. Alternatively, each slot opening 142 may lead into a chamber that is separated from the other chambers by walls. The front side 131 includes a plurality of notches 146 along a bottom edge of the front side 131. As shown, each of the connector contacts 148 is directly attached to the circuit board 141 at one end by, for example, soldering the ends to the circuit board 141. In other embodiments, the ends may form pins that are configured to form an interference fit with thru-holes of the circuit board 141. The connector contacts 148 extend from the circuit board 141 through the connector housing 128 and protrude through the slot openings 142. In one embodiment the connector contacts 148 are aligned with respect to each other along a width of the connector housing 128 (i.e., along the axis 192). Alternatively, the connector contacts 148 are not aligned and have a staggered relationship along the width of the connector housing 148.

As will be discussed in greater detail below, when the mating contacts 124 (FIG. 2) are moved in an axial direction along the plane formed by axes 191 and 192, each mating contact 124 may engage a corresponding connector contact 148. If the mating contacts 124 continue to move along the axial direction after engaging the connector contacts 148, the connector contacts 148 are pushed away from the front side 131 toward the back side 132 in the axial direction. The connector contacts 148 are resilient in that the connector contacts 148 resile or resist movement away from the unengaged position thereby maintaining an electrical connection with the corresponding mating contact 124. If and when the mating contact 124 is removed, the connector contact 148 may return to substantially the same position.

Figure 5:
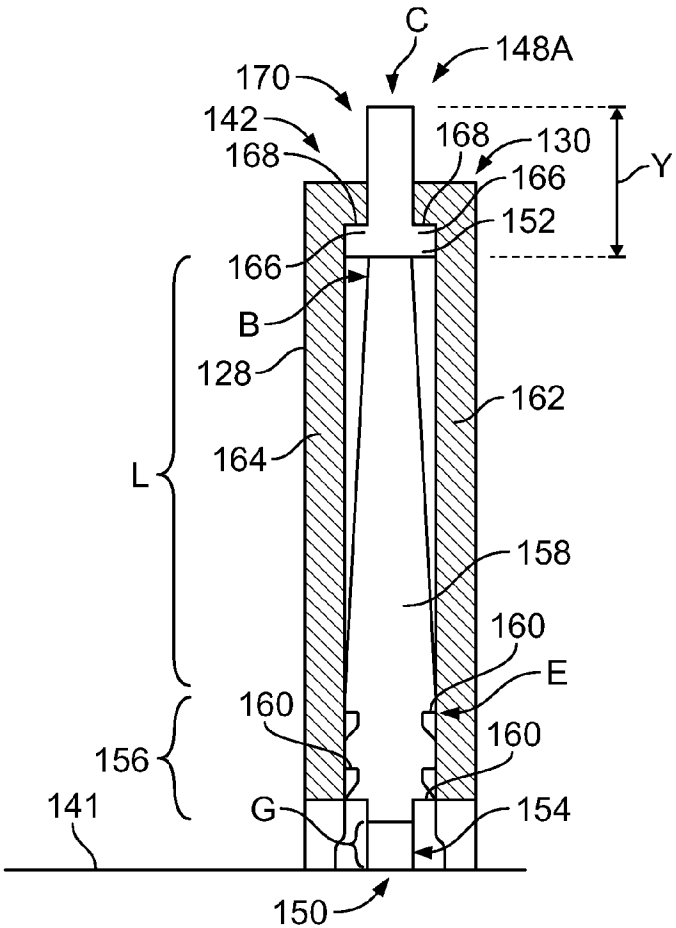
FIG. 5 is a front view of the connector contact taken along the line 5-5 shown in FIG. 3.
Figure 4:
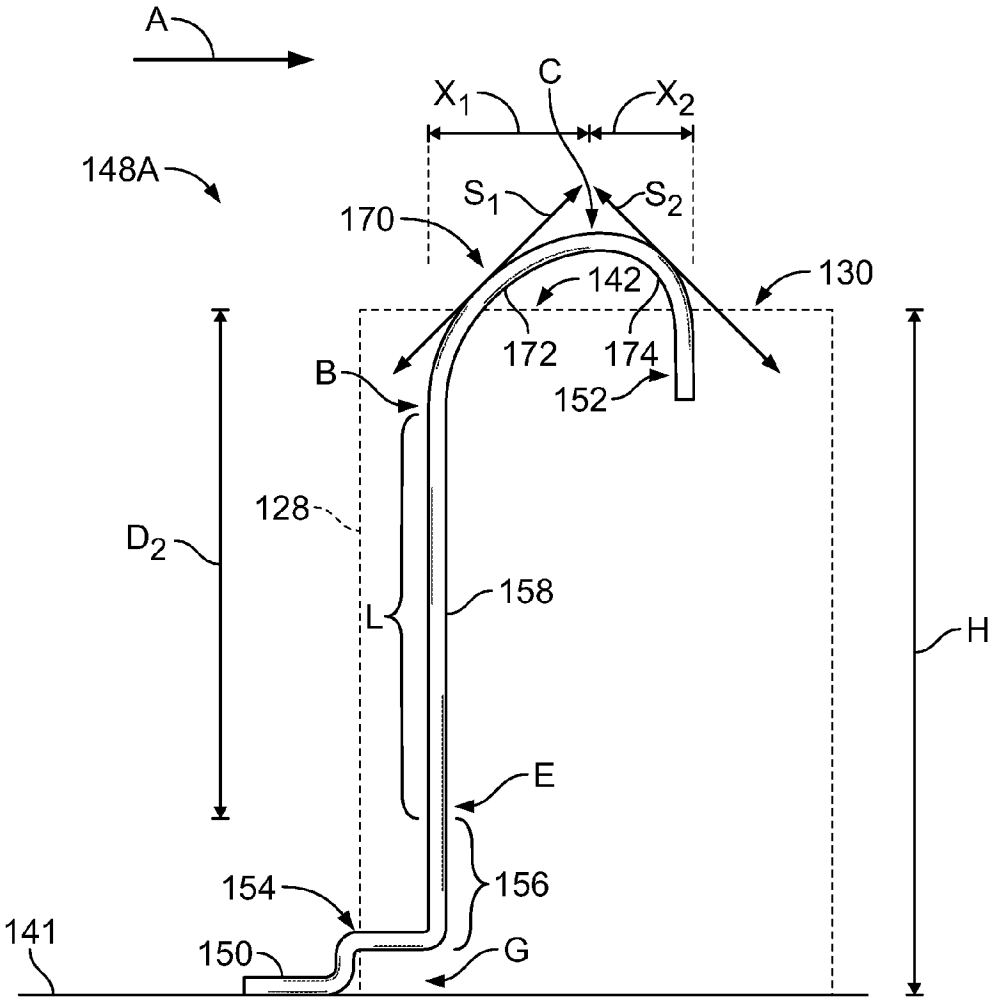
FIG. 4 is a side view of a connector contact taken along the line 4-4 shown in FIG. 3.

FIGS. 4 and 5 illustrate the connector contact 148 in a relaxed or unengaged condition. Specifically, FIG. 4 is a cross-sectional side view of the connector contact 148A taken along the line 4-4 in FIG. 3, and FIG. 4 is a front view of the connector contact 148A taken along the line 5-5 shown in FIG. 3. Although the connector contact 148A is described here in detail, the description may be similarly applied to the other connector contacts 148. The connector contact 148A is shaped and formed to resiliently flex in the axial direction (indicated by the arrow A in FIG. 4) and extends between a tail end 150 (FIG. 4) and a distal end 152. As shown, the connector contact 148A includes an elbow portion 154 that extends from the tail end 150, curves and extends alongside a surface of the circuit board 141, and forms a gap G between the elbow portion 154 and the surface of the circuit board 141. The elbow portion 154 then curves upward and forms into a base portion 156 that extends away from the circuit board 141. As shown in FIG. 5, the base portion 156 includes ridges 160 that project outward from edges of the base portion 156 and are held between inner wall portions 162 and 164 of the connector housing 128. (The connector housing 128 is shown by phantom outline in FIG. 4.) The ridges 160 may grip and/or be compressed between the wall portions 162 and 164. The base portion 156 extends away from the circuit board 141 and forms a beam 158. In the illustrated embodiment, the beam 158 is substantially linear and extends a length L in a direction that is substantially perpendicular to the axial direction A and the surface of the circuit board 141. As shown in FIG. 4, a width of the beam 158 narrows or tapers as the beam 158 extends upward and continues to narrow until the connector contact 148A protrudes through the slot opening 142. As such, in the exemplary embodiment, the connector contact 148A is free to flex from a depth $D_2$ (FIG. 4) into the connector housing 128 at point E where the base portion 156 forms into the beam 158. As will be discussed in greater detail below, the length L of beam 158 allows movement of a curved portion 170 in the axial direction.

In the illustrated embodiment the length L of the beam 158 provides for more than half of the depth $D_2$. In one embodiment, the length L of the beam 158 provides a substantial majority of the depth $D_2$. Also, the beam 158 may provide for a substantial portion of a height H of the connector housing 128.

The curved portion 170 is formed from the beam 158 approximately at a point B near the slot opening 142. The curved portion 170 extends beyond the mating face 130 to the distal end 152. The curved portion 170 is configured to engage with the mating contact 122 or 124 and, in one embodiment, may engage with a mating contact having a first axial position on one module and engage with another mating contact having a second axial position on a different module. More specifically as shown in FIG. 4, the curved portion 170 may have a mating section 172 that extends from point B to an apex point C and a forward-facing section 174 that extends between point C and the distal end 152. The mating section 172 has a slope $S_1$ and the forward-facing section has a slope $S_2$. In the illustrated embodiment, the magnitude of $S_1$ is less than the magnitude of $S_2$ (i.e., $S_1$ is gentler or shallower than S-). Specifically, in comparison to a common vertical distance Y (FIG. 5) that extends between point B/the distal end 152 and point C, the mating section 172 extends a distance $X_1$ in the axial direction, and the forward-facing section 174 extends a distance $X_2$ in the axial direction. The distance $X_1$ is greater than the distance $X_2$.

In one embodiment the magnitude of the slope $S_1$ through the mating section 172 is continuously changing (i.e., the mating section 172 does not include a portion that is substantially linear). Likewise, in one embodiment, the magnitude of the slope S2 through the forward-facing section 174 is continuously changing.

The distal end 152 may extend in a direction that is substantially perpendicular to the axial direction A. In the illustrated embodiment, the curved portion 170 returns through the slot opening 142 and forms the distal end 152. As shown in FIG. 5, the distal end 152 may include projections 166 that grip slot edges 168 formed by the slot opening 142. The edges 168 project inwardly from the inner wall portions 164 and 162. When the connector contact 148A is in the unengaged condition, the projections 166 may grip the edges 168 preventing the curved portion 170 from flexing out of the slot opening 142. Alternatively the distal end 152 does not include projections 166 and/or does not return through the slot opening 142.

Figure 6:
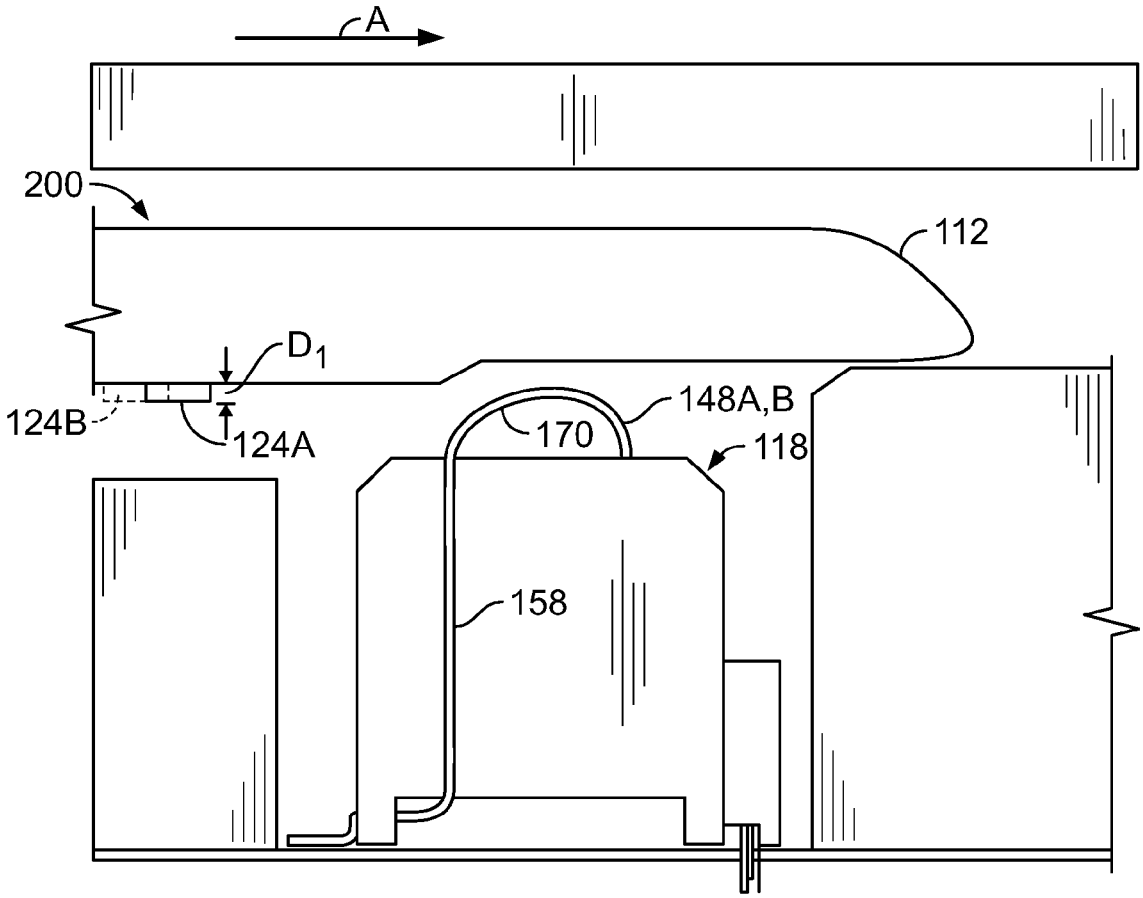
FIG. 6 is a side view of the connector shown in FIG. 3 before the connector engages the module shown in FIG. 2.
Figure 7:
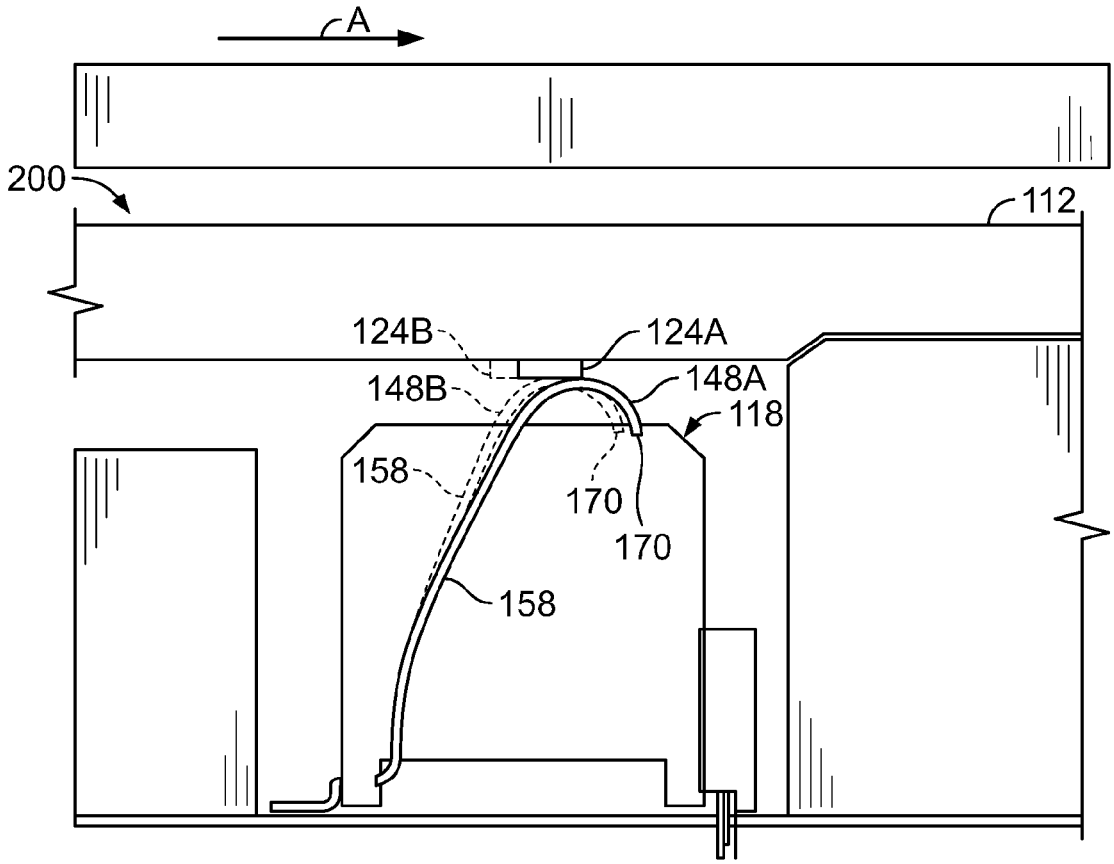
FIG. 7 is a side view of the connector shown in FIG. 3 when the connector is engaged the module shown in FIG. 2.

FIGS. 6 and 7 are side views of the connector 118 disposed within a cavity 200 of the device 102 (FIG. 1) when the mating face 112 of the module 106 (FIG. 2) is inserted into the cavity 200. (For illustrative purposes, only the connector contacts 148A and 148B and only the corresponding mating contacts 124A and 124B are shown.) More specifically FIG. 6 illustrates the relaxed condition of the connector contacts 148A and 148B (the connector contact 148B is behind connector contact 148A in FIG. 6) and FIG. 7 illustrates the flexed or compressed condition of the connector contacts 148A and 148B.

The cavity 200 may be keyed or grooved so that when the mating face 112 is advanced through the cavity 200 in the axial direction A, the mating face 112 is directed into a certain position so that the mating contacts 124A and 124B may engage the connector contacts 148A and 148B. As shown in FIGS. 6 and 7, the mating contacts 124A and 124B project downward in a direction that is perpendicular to the axial direction A. In the exemplary embodiment the mating contacts 124A and 124B have different axial locations on the mating face 112 such that the mating contact 124A engages the connector contact 148A before the mating contact 124B engages the mating contact 148B. When the mating contacts 124A and 124B engage the curved portions 170 of the connector contacts 148A and 148B, the beams 158 pivot about the respective base portion 156 (FIG. 4) causing the respective curved portions 170 to move within and along the respective slot opening 142. In the fully engaged or locked position shown in FIG. 7, the connector contacts 148A and 148B may have different flexed or compressed conditions (i.e., the connector contact 148A is more flexed than the connector contact 148B). Specifically in the fully engaged position, the beam 158 (FIG. 4) of the connector contact 148A is flexed to a greater angle with respect to the beam 158 in the unengaged condition than the beam 158 of the connector contact 148B is flexed. As such, the curved portion 170 of the connector contact 148 has moved a greater axial distance than the curved portion 170 of the connector contact 148B has moved.

In addition to the beams 158 being able to move the respective curved portions 170 an axial distance, the shape of the curved portions 170 may be configured to maintain an electrical connection with the respective mating contact 124 as discussed above. Specifically the curved portions 170 may include mating sections 172 that have a slope configured to maintain an electrical connection after engaging the mating contact 124 as the mating contact 124 is moved in the axial direction.

In an alternative embodiment more than one of the electrical connectors 118 may be positioned within the cavity 200. For example, one connector 118 may be placed above another electrical connector 118. The electrical connectors 118 may oppose each other such that the corresponding mating faces 130 face each other within the cavity 200. In such embodiments, the mating face 112 may have mating contacts on both a side facing upward and a side facing downward and engage with both electrical connectors 118.

Figure 8:
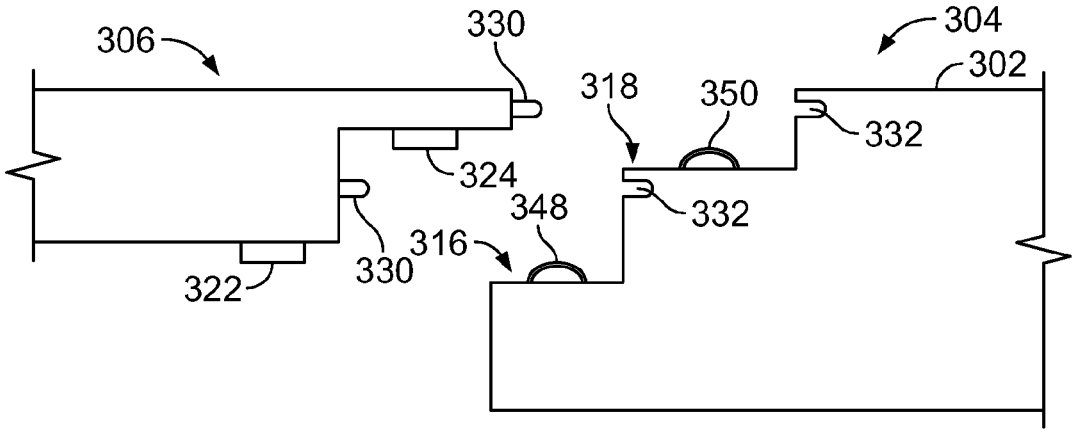
FIG. 8 is a side view of a pair of electrical connectors formed in accordance with another embodiment.

FIG. 8 is a side view of a pair of electrical connectors 316 and 318 formed in accordance with another embodiment. The electrical connectors 316 and 318 may have bodies that are integrally formed with the device housing 302 of an electronic device 304. The connectors 316 and 318 include connector contacts 348 and 350, respectively, that may have similar features as described above with respect to the connector contacts 148 (FIGS. 4 and 5). The connector contacts 348 and 350 may be separately coupled to different electrical components (e.g., circuit boards) or may couple to the same electrical component. The electrical connectors 316 and 318 may be staged with respect to each other such that the connector contacts 348 are lower than the connector contacts 350. As shown, the device 304 is configured to mate with a module 306, which has staged mating contacts 322 and 324. The module 306 may include one or more guiding pins 330 that are configured to be inserted into and engage an aperture 332 formed by the device housing 302. When the module 306 is fully engaged with the device 304, the guiding pins 330 are inserted into the apertures 332 and the mating contacts 322 and 324 are engaged with the connector contacts 348 and 350, respectively.

In alternative embodiments to the assembly 100 described in FIG. 1, the electrical connectors 116 and 118 are coupled to or part of the module 106 and the mating contacts 122 and 124 are part of the devices 102 and 104, respectively.

It is to be understood that the above description is intended to be illustrative, and not restrictive. As such, the above-described embodiments (and/or aspects thereof) may be used in combination with each other. Furthermore, although the above description referred to using the electrical connectors 116 and 118 to mechanically and electrically interconnect a peripheral device to a master device, embodiments described above may be used in a variety of electronic devices and systems that require electrically and/or mechanically coupling two or more systems or devices.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector configured to interconnect first and second electrical components, the connector comprising:

a connector housing having a mating face extending substantially in an axial direction, the mating face having a slot opening; and a connector contact extending through the connector housing and the slot opening and being electrically coupled to the first electrical component, the connector contact having a base portion located at a depth within the connector housing and a curved portion formed along and protruding through the slot opening and beyond the mating face, the curved portion having a mating section that extends from the mating face to an apex located a distance away from the mating face, the curved portion also having a forward-facing section that extends from the apex, the forward-facing section extending back toward the connector housing, the mating and forward-facing sections having corresponding slopes, the slope of the mating section being shallower than the slope of the forward-facing section;

wherein the connector contact includes a beam connecting the base portion and the curved portion, the beam extending in a direction that is substantially perpendicular to the mating face of the connector housing; and wherein the connector contact is configured to pivot about the base portion when a mating contact of the second electrical component is moved alongside the mating face in the axial direction and engages the mating section of the curved portion, the curved portion being movable within and along the slot opening in the axial direction.

2. The electrical connector in accordance with claim 1 wherein the forward-facing section of the curved portion includes a distal end held within the connector housing near the mating face, the distal end having projections that grip the connector housing to prevent the curved portion from flexing out of the slot opening.

3. The electrical connector in accordance with claim 1 wherein the connector housing includes a pair of opposing inner wall portions, the base portion of the connector contact extending in a direction that is substantially perpendicular to the mating face and being at least one of gripped and compressed by and between the inner wall portions.

4. The electrical connector in accordance with claim 1 wherein the slope of the mating section is configured to maintain an electrical connection with the mating contact after the mating contact engages the mating section and moves the curved portion in the axial direction.

5. The electrical connector in accordance with claim 1 further comprising a plurality of slot openings extending along the mating face and a plurality of connector contacts, each connector contact extending through the connector housing and one of the slot openings.

6. The electrical connector in accordance with claim 5 wherein the connector contacts are aligned in a row.

7. The electrical connector in accordance with claim 5 wherein the connector contacts pivot in a common direction.

8. The connector in accordance with claim 1 wherein the mating section of the curved portion extends a first distance in the axial direction from a first point along the mating face to the apex and the forward-facing section extends a second distance in the axial direction from the apex to a second point along the mating face, the first distance being greater than the second distance.

9. The connector in accordance with claim 1 wherein the beam has a width that narrows as the beam extends between the base and curved portions within the connector housing.

10. The connector in accordance with claim 1 wherein the connector housing has front and back sides that face an exterior of the connector housing, the mating face of the connector housing extending between the front and back sides, wherein the connector contact extends proximate to the front side of the connector housing when extending therethrough, the curved portion extending toward the back side of the connector housing and being movable toward the back side when the mating contact engages the mating section.

11. The electrical connector in accordance with claim 1 wherein the forward-facing section curves directly from the apex back toward the connector housing.

12. An electrical connector configured to interconnect first and second electrical components, the connector comprising:

a connector housing having a mating face extending substantially in an axial direction, the mating face having a slot opening; and a connector contact extending through the connector housing and the slot opening and being electrically coupled to the first electrical component, the connector contact having a base portion located at a depth within the connector housing and a curved portion formed along and protruding through the slot opening and beyond the mating face, the curved portion having a mating section that extends from the mating face to an apex located a distance away from the mating face, wherein the connector contact includes a beam connecting the base portion and the curved portion, the beam extending in a direction that is substantially perpendicular to the mating face and forming directly into the curved portion that protrudes through the slot opening, the curved portion extending in the axial direction;

wherein the connector contact is configured to pivot about the base portion when a mating contact of the second electrical component is moved alongside the mating face in the axial direction and engages the mating section of the curved portion, the curved portion being movable within and along the slot opening in the axial direction.

13. An electrical device comprising:

a device housing having a cavity configured to receive an electronic module, the cavity being sized and shaped to direct the module into the cavity in an axial direction, the module having a mating face that faces a direction that is substantially perpendicular to the axial direction; and an electrical connector positioned within the cavity of the device housing to engage the mating face of the module when the module is inserted therein, the electrical connector comprising:

a connector housing having a mating face extending substantially in the axial direction, the mating face of the connector housing having a slot opening, the mating face of the module moving along the mating face of the connector housing when inserted into the cavity; and a connector contact extending through the connector housing and the slot opening, the connector contact having a base portion located a depth within the connector housing and a curved portion formed along and protruding through the slot opening and beyond the mating face of the connector housing, the connector contact also including a beam that connects the base portion and the curved portion, the beam extending in a direction that is substantially perpendicular to the mating face of the connector housing, wherein the connector contact is configured to pivot about the base portion when a mating contact on the mating face of the module is moved alongside the mating face of the connector housing in the axial direction and engages the curved portion, the curved portion being movable within and along the slot opening in the axial direction.

14. The device in accordance with claim 13 wherein the curved portion includes a distal end held within the connector housing near the mating face of the connector housing.

15. The device in accordance with claim 13 wherein the connector housing includes a pair of opposing inner wall portions, the base portion of the connector contact being held by and between the inner wall portions.

16. The device in accordance with claim 13 wherein the curved portion has a mating section that faces and engages the mating contact of the module, the mating section having a slope configured to maintain an electrical connection with the mating contact as the mating contact is moved in the axial direction.

17. The device in accordance with claim 13 wherein the mating contact includes a plurality of mating contacts, the slot opening includes a plurality of slot openings extending along the mating face of the connector housing, and the connector contact includes a plurality of connector contacts, each connector contact extending through the connector housing and one of the slot openings to engage one of the mating contacts.

18. The device in accordance with claim 17 wherein the connector contacts pivot in a common direction.

19. The device in accordance with claim 13 wherein the connector contact includes first and second connector contacts, wherein the first and second connector contacts pivot in a common direction from an unengaged condition to a flexed condition when engaged by corresponding mating contacts of the module, the first and second connector contacts configured to have different flexed conditions such that the respective curved portions are moved different axial distances in the axial direction.

20. The device in accordance with claim 13 wherein the curved portion has a mating section that extends from the mating face of the connector housing to an apex located a distance away from the mating face of the connector housing, the curved portion also having a forward-facing section that extends from the apex, the forward-facing section extending back toward the connector housing, the mating and forward-facing sections having corresponding slopes, the slope of the mating section being shallower than the slope of the forward-facing section.

* * * * *